US009736908B2

(12) United States Patent
Phan et al.

(10) Patent No.: US 9,736,908 B2
(45) Date of Patent: Aug. 15, 2017

(54) PIXEL STRUCTURE

(71) Applicant: VP ASSETS LIMITED, Road Town (VG)

(72) Inventors: Gia-Chuong Phan, Berlin (DE); Maggie Phan, Vancouver (CA); Anthony Phan, Vancouver (CA)

(73) Assignee: VP ASSETS LIMITED, Road Town (VG)

( * ) Notice: Subject to any disclaimer, the term of this patent is extended or adjusted under 35 U.S.C. 154(b) by 58 days.

(21) Appl. No.: 14/968,852

(22) Filed: Dec. 14, 2015

(65) Prior Publication Data

US 2016/0174331 A1 Jun. 16, 2016

Related U.S. Application Data

(60) Provisional application No. 62/091,518, filed on Dec. 13, 2014.

(51) Int. Cl.
*H01J 1/62* (2006.01)
*H05B 33/12* (2006.01)

(52) U.S. Cl.
CPC ..... *H05B 33/12* (2013.01)

(58) Field of Classification Search
CPC .. H05B 33/12; H01L 27/3244; H01L 27/5281
USPC ..... 313/505, 498, 506, 512
See application file for complete search history.

(56) References Cited

U.S. PATENT DOCUMENTS 8,144,094 B2 * 3/2012 Brown Elliott ..... G02F 1/1368 345/694

* cited by examiner

*Primary Examiner* — Vip Patel
(74) *Attorney, Agent, or Firm* — Steven Reiss

(57) ABSTRACT

A pixel structure includes a plurality of first pixel groups and a plurality of second pixel groups. The first pixel groups and the second pixel groups are arranged in a matrix manner. The first pixel groups and the second pixel group are staggered with each other along a first direction, and are simultaneously staggered with each other long a second direction. Each of the first pixel groups comprises a first sub-pixel and a second sub-pixel. Each of the second pixel groups comprises a third sub-pixel and a fourth sub-pixel. Three of the first sub-pixel, the second sub-pixel, the third sub-pixel, and the fourth sub-pixel, which are adjacent to each other, cooperate with each other to form a dynamic pixel unit.

14 Claims, 11 Drawing Sheets

PIXEL STRUCTURE

CROSS-REFERENCE TO RELATED APPLICATIONS

This application claims priority to U.S. Provisional Application No. 62/091,518 filed on Dec. 13, 2014, the contents of which are incorporated by reference herein.

FIELD

The subject matter herein generally relates to a pixel structure.

BACKGROUND

FIG. 1 illustrates a conventional RGB display. The conventional RGB display 10 includes a plurality of RGB pixels 11. Each RGB pixel 11 includes a green sub-pixel 111, a red sub-pixel 112, a blue sub-pixel 113 arranged square in a 1×3 matrix. U.S. Pat. No. 8,354,789 teaches a sub-pixel arrangement with first color sub-pixels and second color sub-pixels alternately arranged in alternating columns and the third color sub-pixels arranged in columns in-between. However, there exist sub-pixels of the same color adjacent to each other, which is unfavorable to sub-pixel color information sharing.

BRIEF DESCRIPTION OF THE FIGURES

Implementations of the present technology will now be described, by way of example only, with reference to the attached figures.

DETAILED DESCRIPTION

Figure 1:
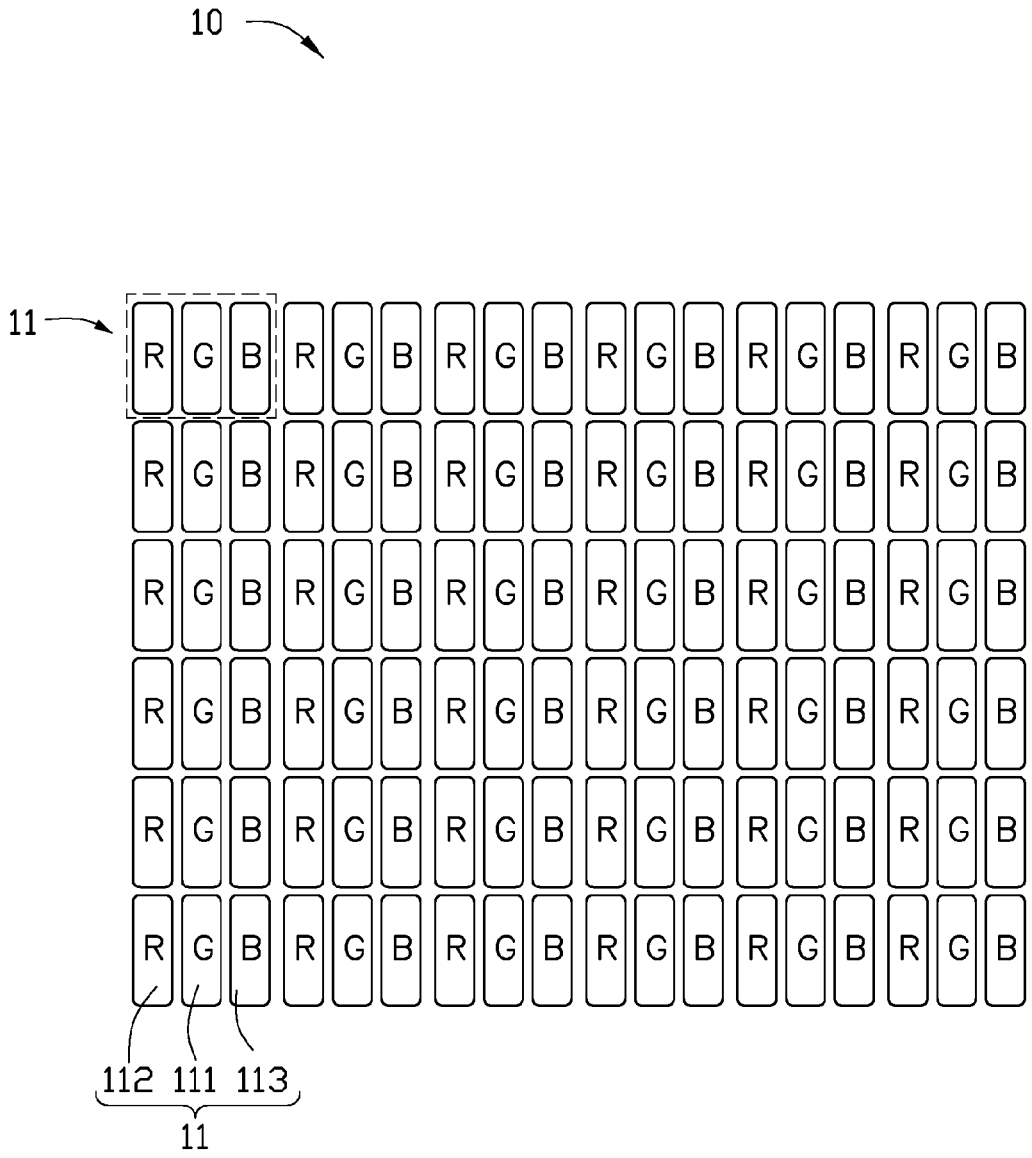
FIG. 1 is a diagrammatic view of an embodiment of a pixel structure in related art.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

The term "comprising" means "including, but not necessarily limited to"; it specifically indicates open-ended inclusion or membership in a so-described combination, group, series, and the like.

Figure 2:
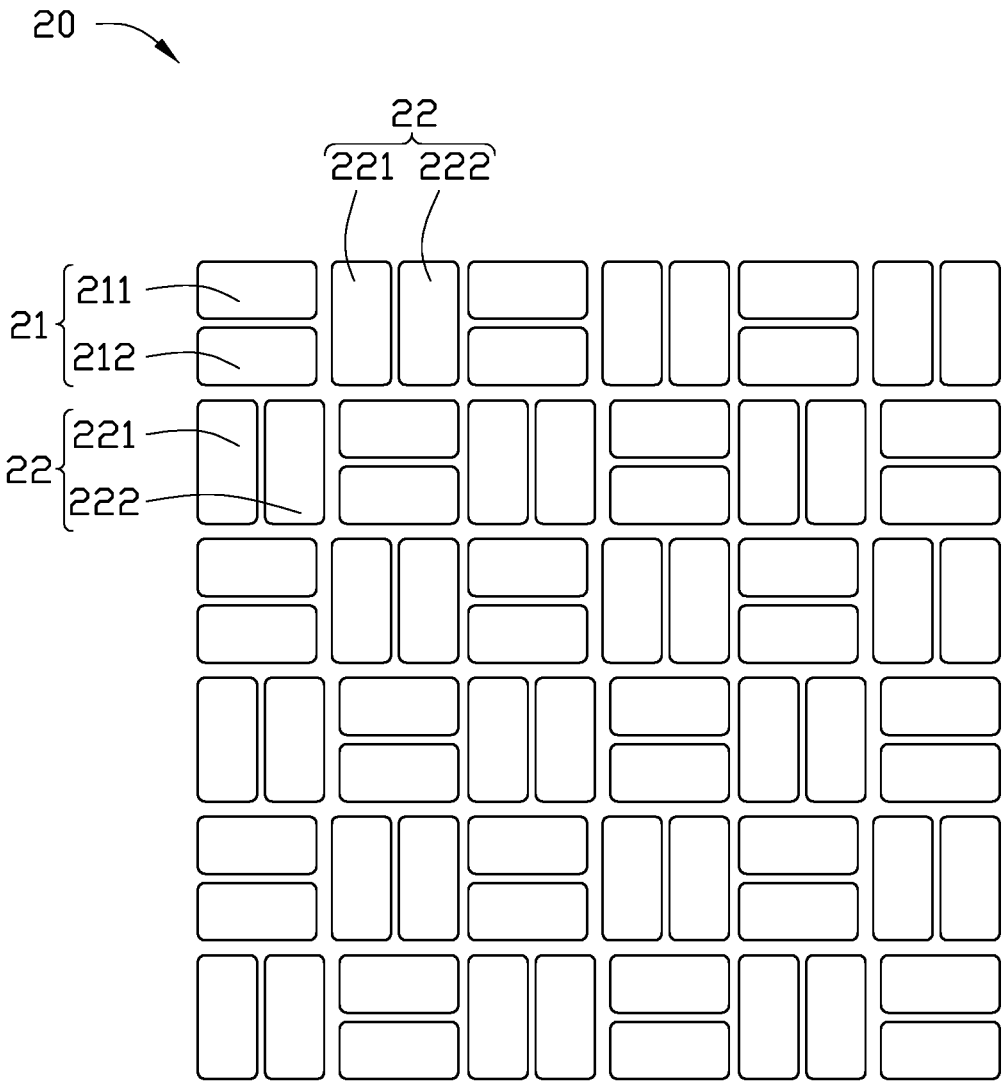
FIG. 2 is a diagrammatic view of a first embodiment of a pixel structure.

FIG. 2 illustrates an embodiment of a pixel structure 20. The pixel structure 20 includes a plurality of first pixel groups 21 and a plurality of second pixel groups 22. The first pixel groups 21 and the second pixel groups 22 are arranged in a matrix manner. The first pixel groups 21 and the second pixel group 22 are staggered with each other along a first direction D1, and also staggered with each other along a second direction D2 perpendicular to the first direction D1. Length of each of the first pixel groups 21 is parallel with the first direction D1, and length of each of the second pixel groups 22 is parallel with the second direction D2.

Each of the first pixel groups 21 includes a first sub-pixel 211 and a second sub-pixel 212. Each of the second pixel groups 22 includes a third sub-pixel 221 and a fourth sub-pixel 222. The first sub-pixel 211 and the second sub-pixel 212 are parallel with each other along the first direction D1. The third sub-pixel 221 and the fourth sub-pixel 222 are parallel with each other along the second direction D2. Three of the first sub-pixel 211, the second sub-pixel 212, the third sub-pixel 221, and the fourth sub-pixel 222, which are adjacent to each other, form a dynamic pixel unit 50. The first pixel group 21 cooperates with an adjacent third sub-pixel 221 along the first direction D1 or an adjacent fourth sub-pixel 222 along the first direction D1 to form the dynamic pixel unit 50. The second pixel group 22 cooperates with an adjacent first sub-pixel 211 along the second direction D2 or an adjacent second dub-pixel 212 along the second direction D2 to form the dynamic pixel unit 50. Each of the first sub-pixel 211, the second sub-pixel 212, the third sub-pixel 221, and the fourth sub-pixel 222 is substantially a rectangular shape. Lengths of the first sub-pixel 211 and the second sub-pixel 212 run parallel with each other along the first direction D1, and lengths of the third sub-pixel 221 and the fourth sub-pixel 222 run parallel with each other along the second direction D2. Widths of the first sub-pixel 211 and the second sub-pixel 212 run parallel with each other along the second direction D2, and width of the third sub-pixel 221 and the fourth sub-pixel 222 run parallel with each other along the first direction D1. The lengths of the first sub-pixel 211, the second sub-pixel 212, the third sub-pixel 221, and the fourth sub-pixel 222 are equal with each other, and the width of the first sub-pixel 211, the second sub-pixel 212, the third sub-pixel 221, and the fourth sub-pixel 222 are equal with each other. In at least one embodiment, each of the first pixel group 21 and the second pixel group 22 further includes at least one driving element (not shown), a pixel electrode (not shown), an anode (not shown), a cathode (not shown), and an organic light emitting layer (not shown).

Figure 3:
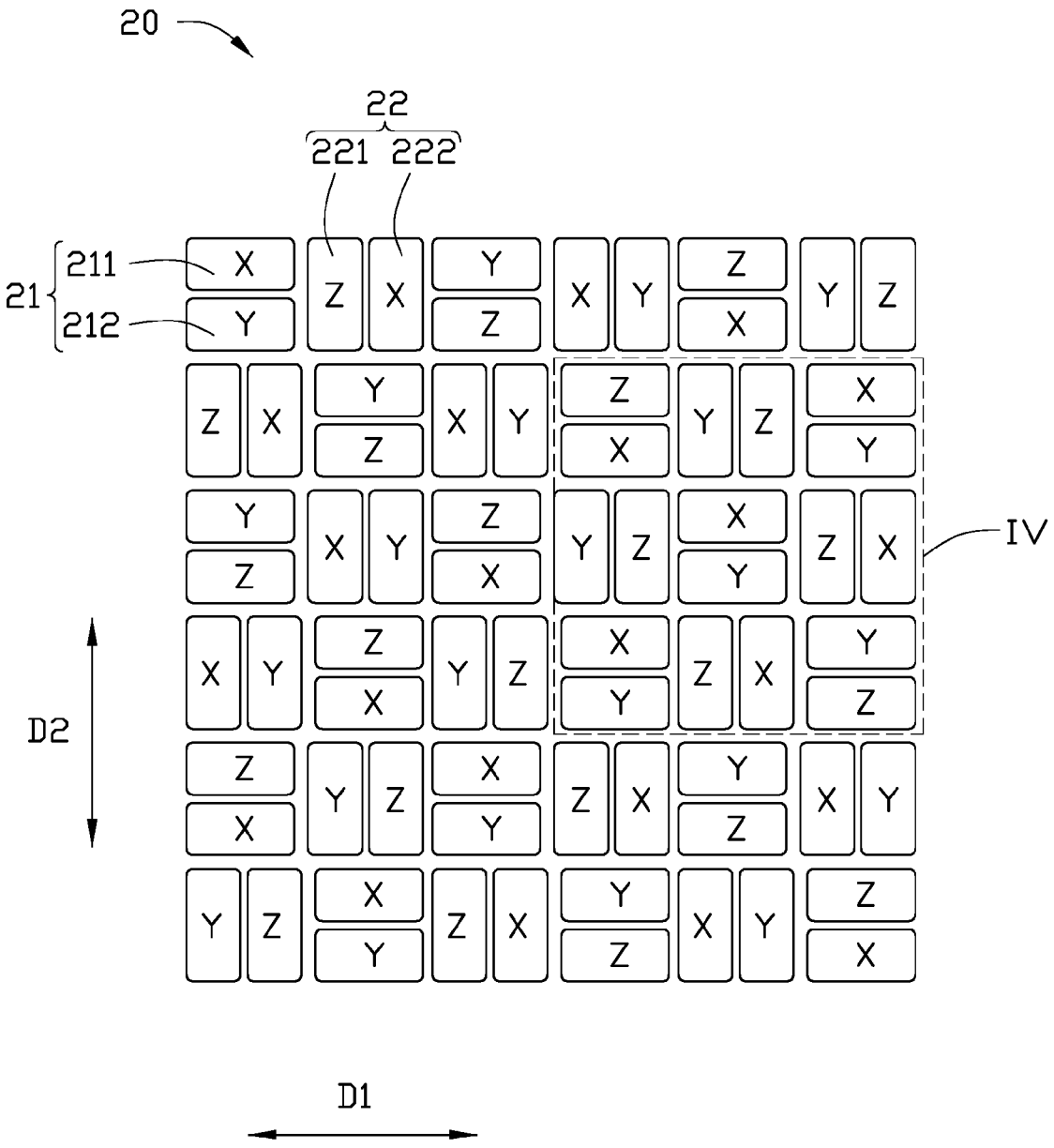
FIG. 3 is a diagrammatic view of the pixel structure in a first format of FIG. 2.

FIG. 3 illustrates the pixel structure 20 in a first format. Each of the first sub-pixel 211, the second sub-pixel 212, the third sub-pixel 221, and the fourth sub-pixel 222 can be one of an X sub-pixel, a Y sub-pixel, and a Z sub-pixel.

Figure 4:
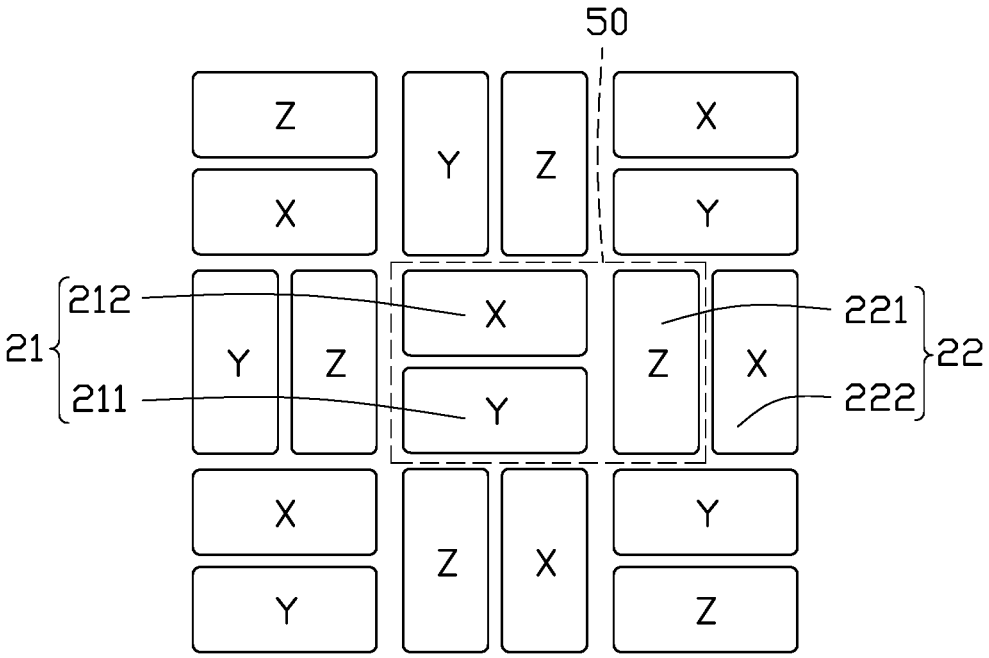
FIG. 4 is an enlarged view of encircled portion IV of a first embodiment of the pixel structure of FIG. 3, the pixel structure comprises a dynamic pixel unit.

FIG. 4 illustrates the dynamic pixel unit 50 formed by the first pixel group 21 and the third sub-pixel 221 of the second pixel group 22 adjacent to the first pixel group 21 along the first direction D1. The first sub-pixel 211 is an X sub-pixel, the second sub-pixel 212 is a Y sub-pixel, and the third sub-pixel 221 is a Z sub-pixel.

Figure 5:
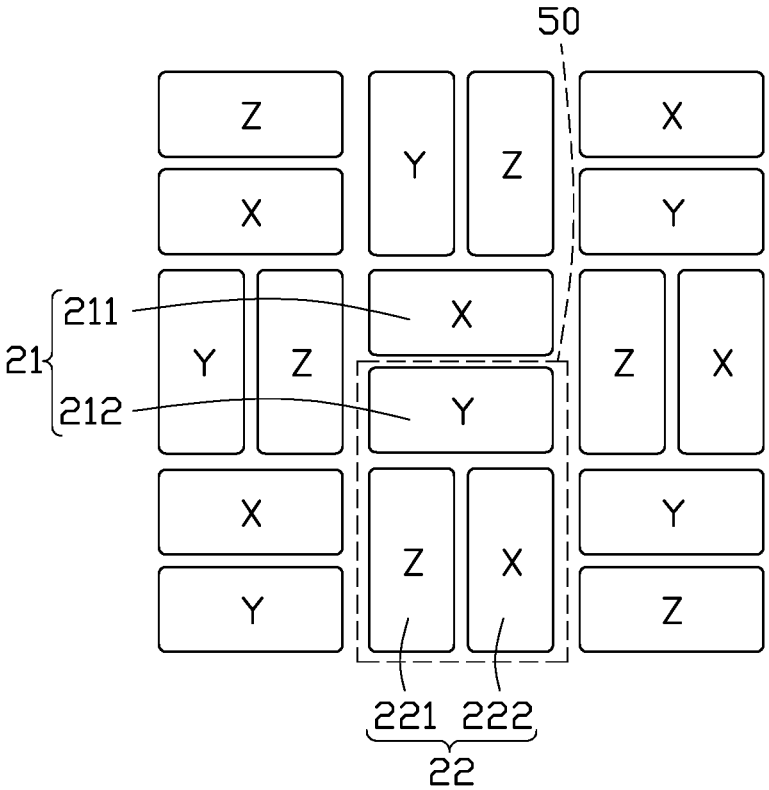
FIG. 5 is a diagrammatic view of a second embodiment of the dynamic pixel unit of FIG. 4.

FIG. 5 illustrates the dynamic pixel unit 50 formed by the second pixel group 22 and the second sub-pixel 212 of the first pixel group 21 adjacent to the second pixel group 22 along the second direction D2. The second sub-pixel 212 is a Y sub-pixel, the third sub-pixel 221 is a Z sub-pixel, and the fourth sub-pixel 222 is an X sub-pixel.

Figure 6:
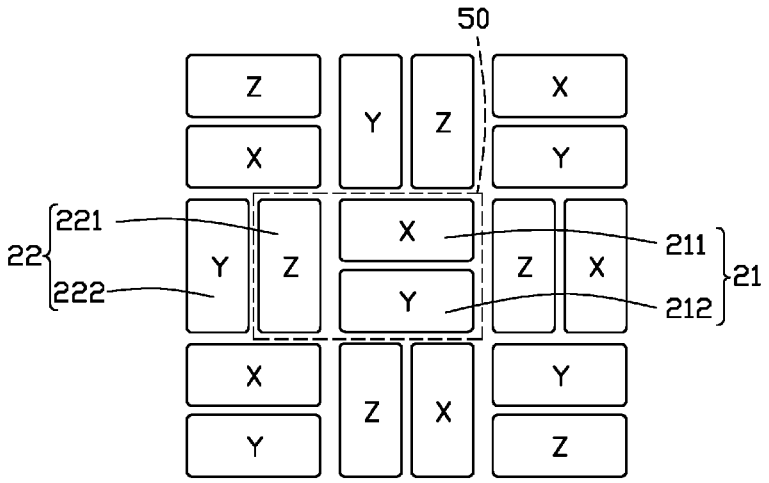
FIG. 6 is a diagrammatic view of a third embodiment of the dynamic pixel unit of FIG. 4.

FIG. 6 illustrates the dynamic pixel unit 50 formed by the first pixel group 21 and the fourth sub-pixel 222 of the second pixel group 22 adjacent to the first pixel group 21 along the first direction D1. The first sub-pixel 211 is an X sub-pixel, the second sub-pixel 212 is a Y sub-pixel, and the fourth sub-pixel 221 is a Z sub-pixel.

Figure 7:
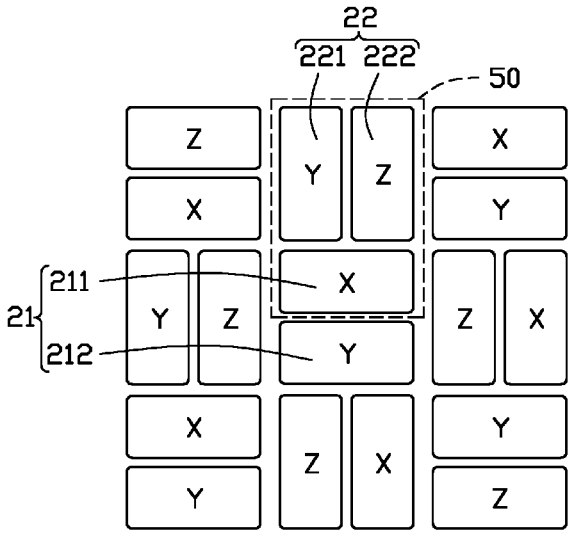
FIG. 7 is a diagrammatic view of a fourth embodiment of the dynamic pixel unit of FIG. 4.

FIG. 7 illustrates the dynamic pixel unit 50 formed by the second pixel group 22 and the first sub-pixel 211 of the first pixel group 21 adjacent to the second pixel group 22 along the second direction D2. The first sub-pixel 212 is an X sub-pixel, the third sub-pixel 221 is a Y sub-pixel, and the fourth sub-pixel 222 is a Z sub-pixel.

Figure 8:
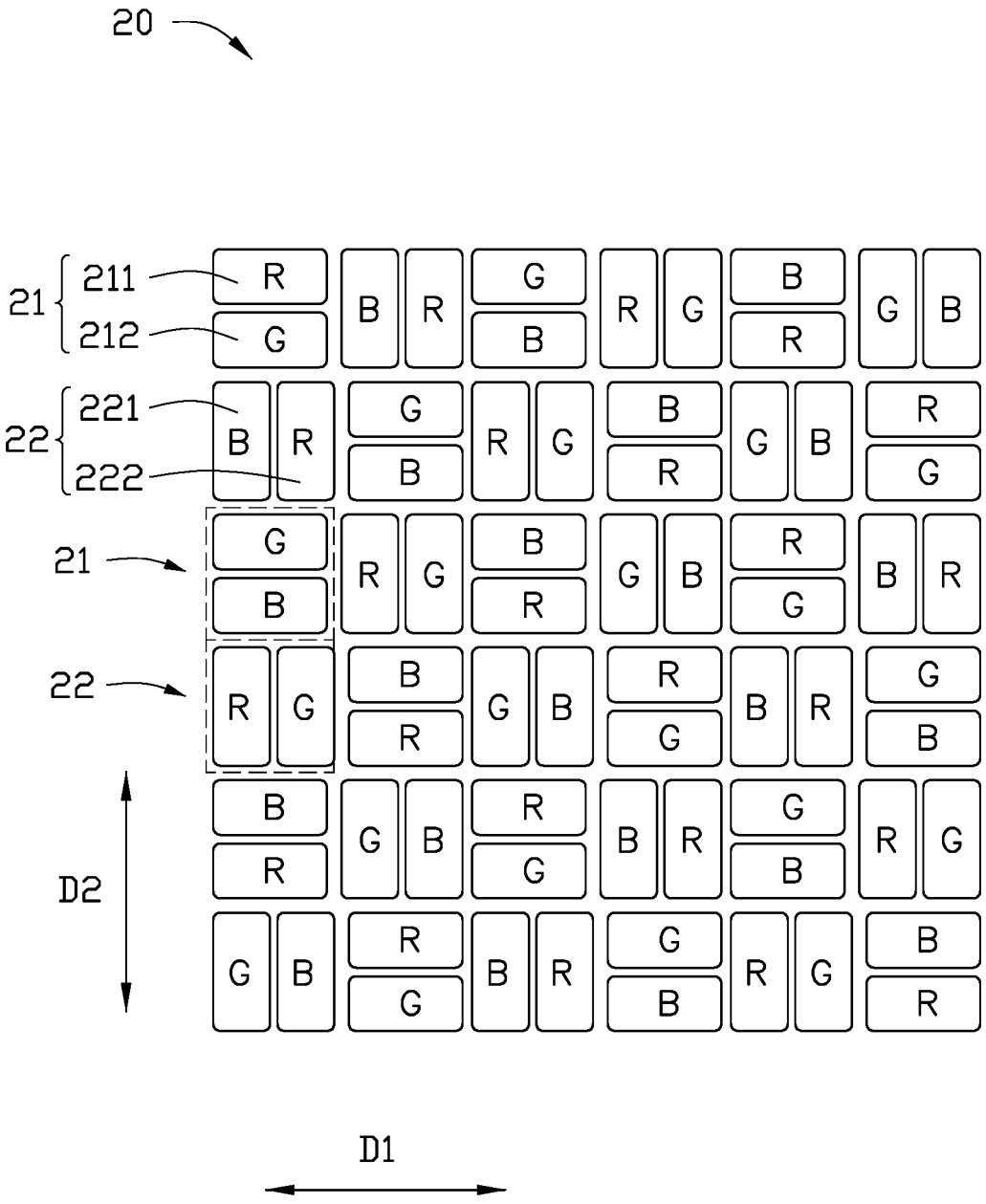
FIG. 8 is a diagrammatic view of the pixel structure in a second format of FIG. 2.

FIG. 8 illustrates the pixel structure 20 in a second format. Each of the first sub-pixel 211, the second sub-pixel 212, the third sub-pixel 221, and the fourth sub-pixel 222 can be one of an R sub-pixel, a G sub-pixel, and a B sub-pixel.

Figure 9:
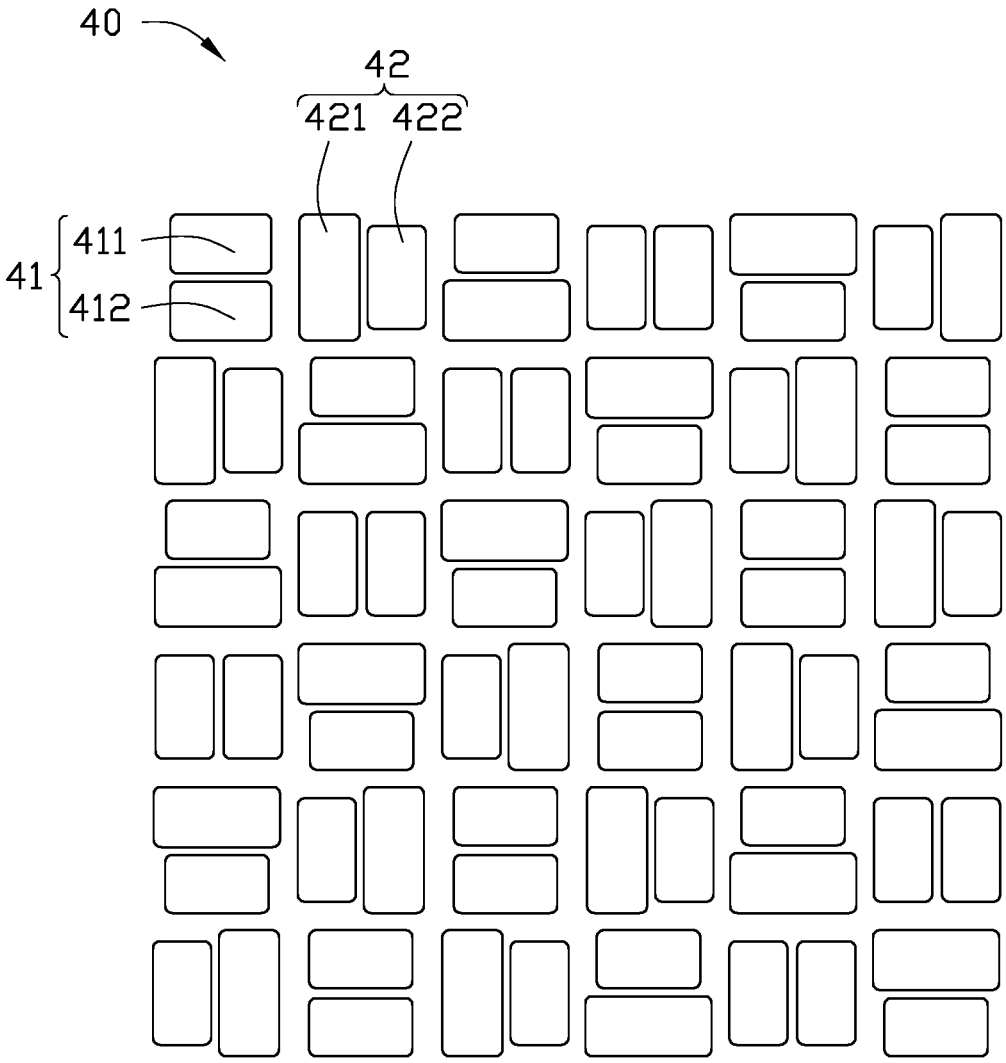
FIG. 9 is a diagrammatic view of a second embodiment of the pixel structure.

FIG. 9 illustrates a second embodiment of the pixel structure 40. The pixel structure 40 includes a plurality of first pixel groups 41 and a plurality of second pixel groups 42. The first pixel groups 41 and the second pixel group 42 are arranged in a matrix manner. The first pixel groups 21 and the second pixel groups 42 are staggered with each other along a first direction D1, and also staggered with each other along a second direction D2 perpendicular to the first direction D1. Length of each of the first pixel groups 41 is parallel with the first direction D1, and length of each of the second pixel groups 42 is parallel with the second direction D2.

Each of the first pixel groups 41 includes a first sub-pixel 411 and a second sub-pixel 412. Each of the second pixel groups 42 includes a third sub-pixel 421 and a fourth sub-pixel 422. The first sub-pixel 411 and the second sub-pixel 412 are parallel with each other along the first direction D1. The third sub-pixel 421 and the fourth sub-pixel 422 are parallel with each other along the second direction D2. Three of the first sub-pixel 411, the second sub-pixel 412, the third sub-pixel 421, and the fourth sub-pixel 422, which are adjacent to each other, form a dynamic pixel unit 60. The first pixel group 41 cooperates with an adjacent third sub-pixel 421 along the first direction D1 or an adjacent fourth sub-pixel 422 along the first direction D1 to form the dynamic pixel unit 60. The second pixel group 42 cooperates with an adjacent first sub-pixel 411 along the second direction D2 or an adjacent second dub-pixel 412 along the second direction D2 to form the dynamic pixel unit 60. Each of the first sub-pixel 411, the second sub-pixel 412, the third sub-pixel 421, and the fourth sub-pixel 422 is substantially a rectangular shape. Lengths of the first sub-pixel 411 and the second sub-pixel 412 run parallel with each other along the first direction D1, and lengths of the third sub-pixel 421 and the fourth sub-pixel 422 run parallel with each other along the second direction D2. Widths of the first sub-pixel 411 and the second sub-pixel 412 run parallel with each other along the second direction D2, and width of the third sub-pixel 421 and the fourth sub-pixel 422 run parallel with each other along the first direction D1. The length of one of the first sub-pixel 411, the second sub-pixel 412, the third sub-pixel 421, and the fourth sub-pixel 422 in the same dynamic unit 50 is different from the rest of the first sub-pixel 411, the second sub-pixel 412, the third sub-pixel 421, and the fourth sub-pixel 422 in the same dynamic unit 50, and the width of the first sub-pixel 411, the second sub-pixel 412, the third sub-pixel 421, and the fourth sub-pixel 422 are equal to each other. In at least one embodiment, each of the first pixel group 41 and the second pixel group 42 further includes at least one driving element (not shown), a pixel electrode (not shown), an anode (not shown), a cathode (not shown), and an organic light emitting layer (not shown).

Figure 10:
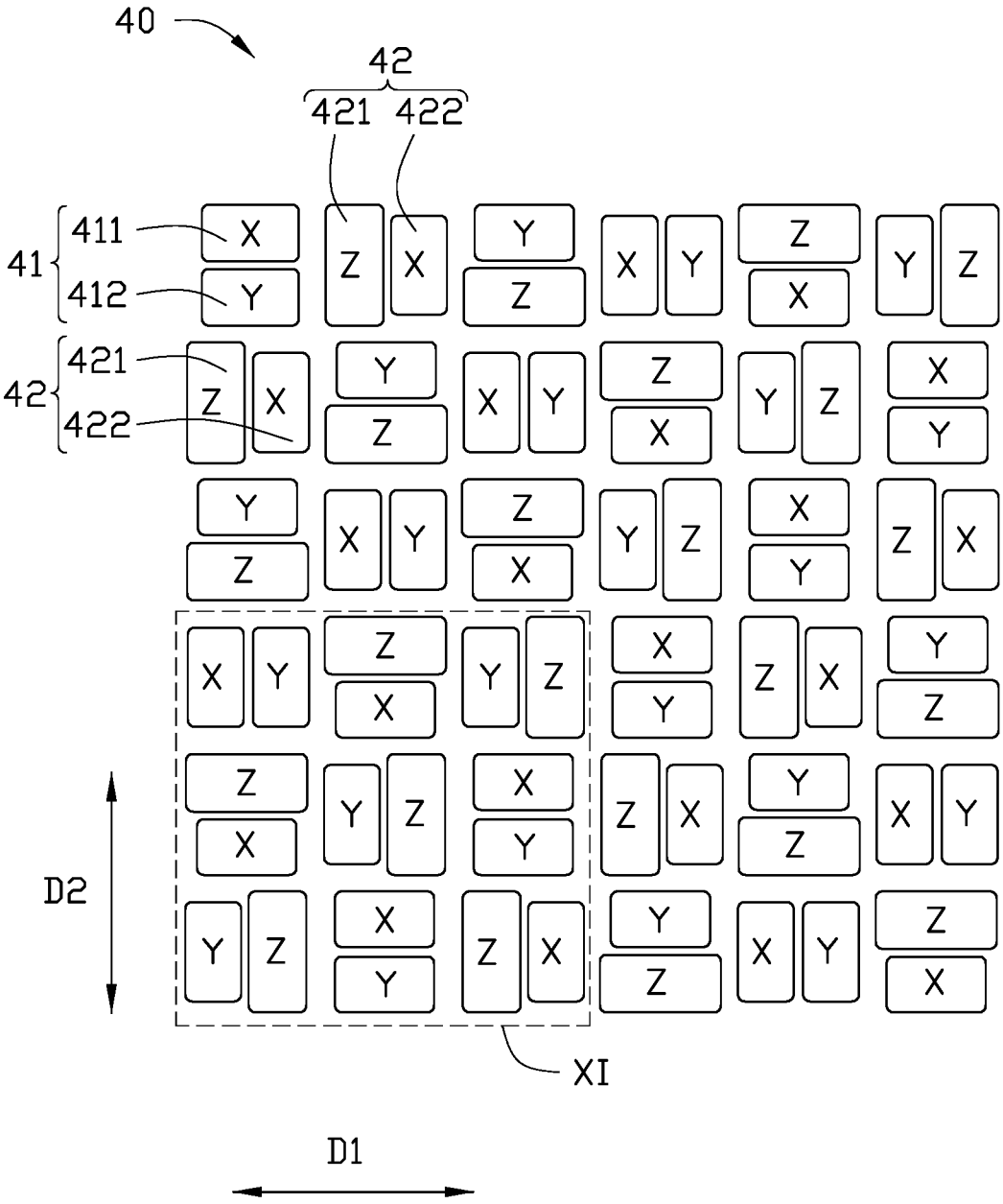
FIG. 10 a diagrammatic view of the pixel structure in a first format of FIG. 9.

FIG. 10 illustrates the pixel structure 40 in a first format. Each of the first sub-pixel 411, the second sub-pixel 412, the third sub-pixel 421, and the fourth sub-pixel 422 can be one of an X sub-pixel, a Y sub-pixel, and a Z sub-pixel.

Figure 11:
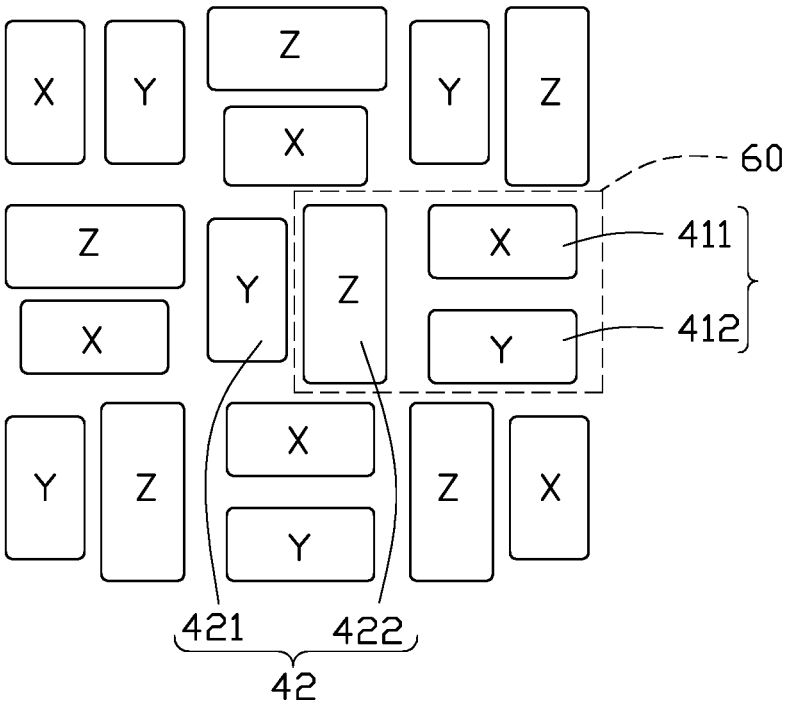
FIG. 11 is an enlarged view of encircled portion XI of a first embodiment of the pixel structure of FIG. 10, the pixel structure comprises a dynamic pixel unit.

FIG. 11 illustrates the dynamic pixel unit 60 formed by the first pixel group 41 and the fourth sub-pixel 422 of the second pixel group 42 adjacent to the first pixel group 41 along the first direction D1. The first sub-pixel 411 is an X sub-pixel, the second sub-pixel 412 is a Y sub-pixel, and the fourth sub-pixel 422 is a Z sub-pixel. The length of the fourth sub-pixel 422 is longer than the length of the first sub-pixel 411 or the second sub-pixel 412.

Figure 12:
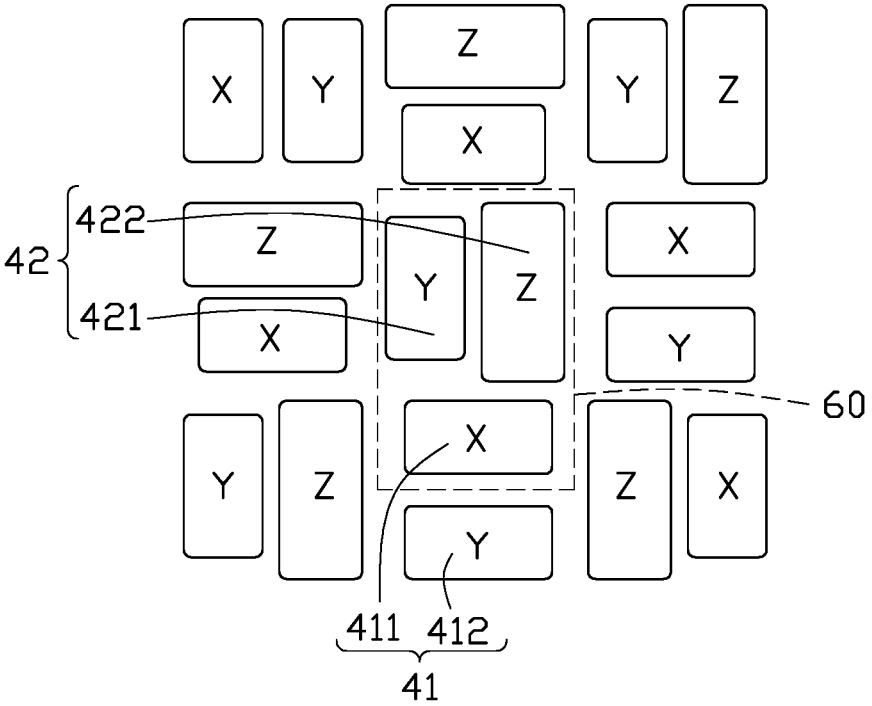
FIG. 12 is a diagrammatic view of a second embodiment of the dynamic pixel unit of FIG. 11.

FIG. 12 illustrates the dynamic pixel unit 60 formed by second pixel group 42 and the first sub-pixel 411 of the first pixel group 41 adjacent to the second pixel group 42 along the second direction D2. The first sub-pixel 411 is a X sub-pixel, the third sub-pixel 421 is a Y sub-pixel, and the fourth sub-pixel 422 is a Z sub-pixel. The length of the fourth sub-pixel 422 is longer than the length of the first sub-pixel 411 or the third sub-pixel 421.

Figure 13:
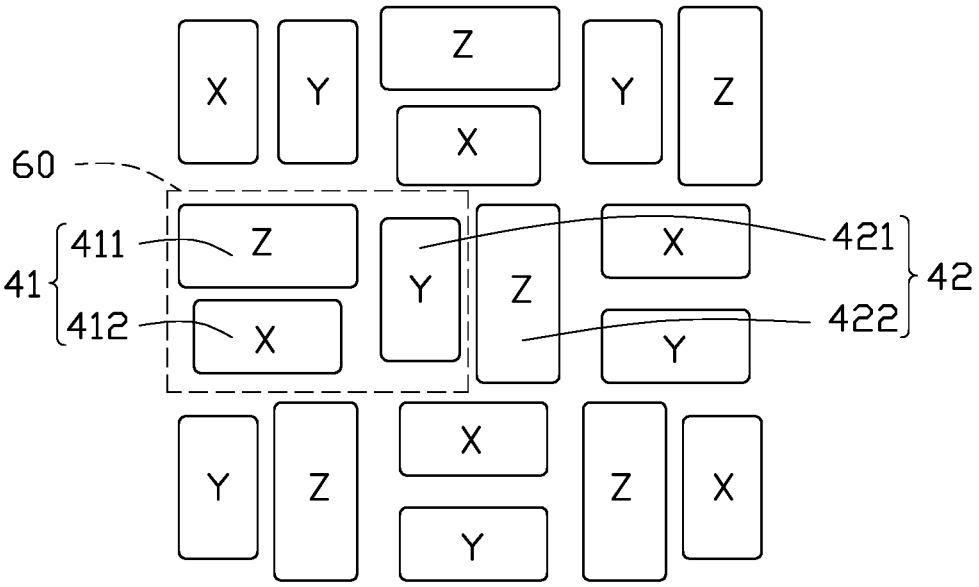
FIG. 13 is a diagrammatic view of a third embodiment of the dynamic pixel unit of FIG. 11.

FIG. 13 illustrates the dynamic pixel unit 60 formed by the first pixel group 41 and the third sub-pixel 421 of the second pixel group 42 adjacent to the first pixel group 41 along the first direction D1. The first sub-pixel 412 is a Z sub-pixel, the second sub-pixel 412 is an X sub-pixel, and the third sub-pixel 421 is a Y sub-pixel. The length of the first sub-pixel 421 is longer than the length of the second sub-pixel 412 or the third sub-pixel 421.

Figure 14:
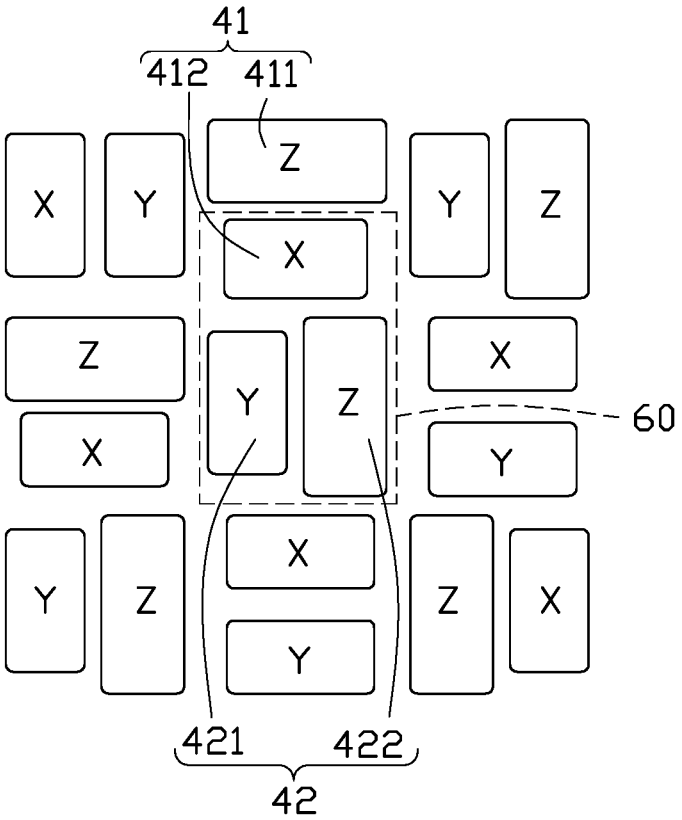
FIG. 14 is a diagrammatic view of a fourth embodiment of the dynamic pixel unit of FIG. 11.

FIG. 14 illustrates the dynamic pixel unit 60 formed by the second pixel group 42 and the second sub-pixel 412 of the first pixel group 41 adjacent to the second pixel group 42 along the second direction D2. The second sub-pixel 412 is an X sub-pixel, the third sub-pixel 412 is a Y sub-pixel, and the fourth sub-pixel 421 is a Z sub-pixel. The length of the fourth sub-pixel 422 is longer than the length of the second sub-pixel 412 or the third sub-pixel 421.

Figure 15:
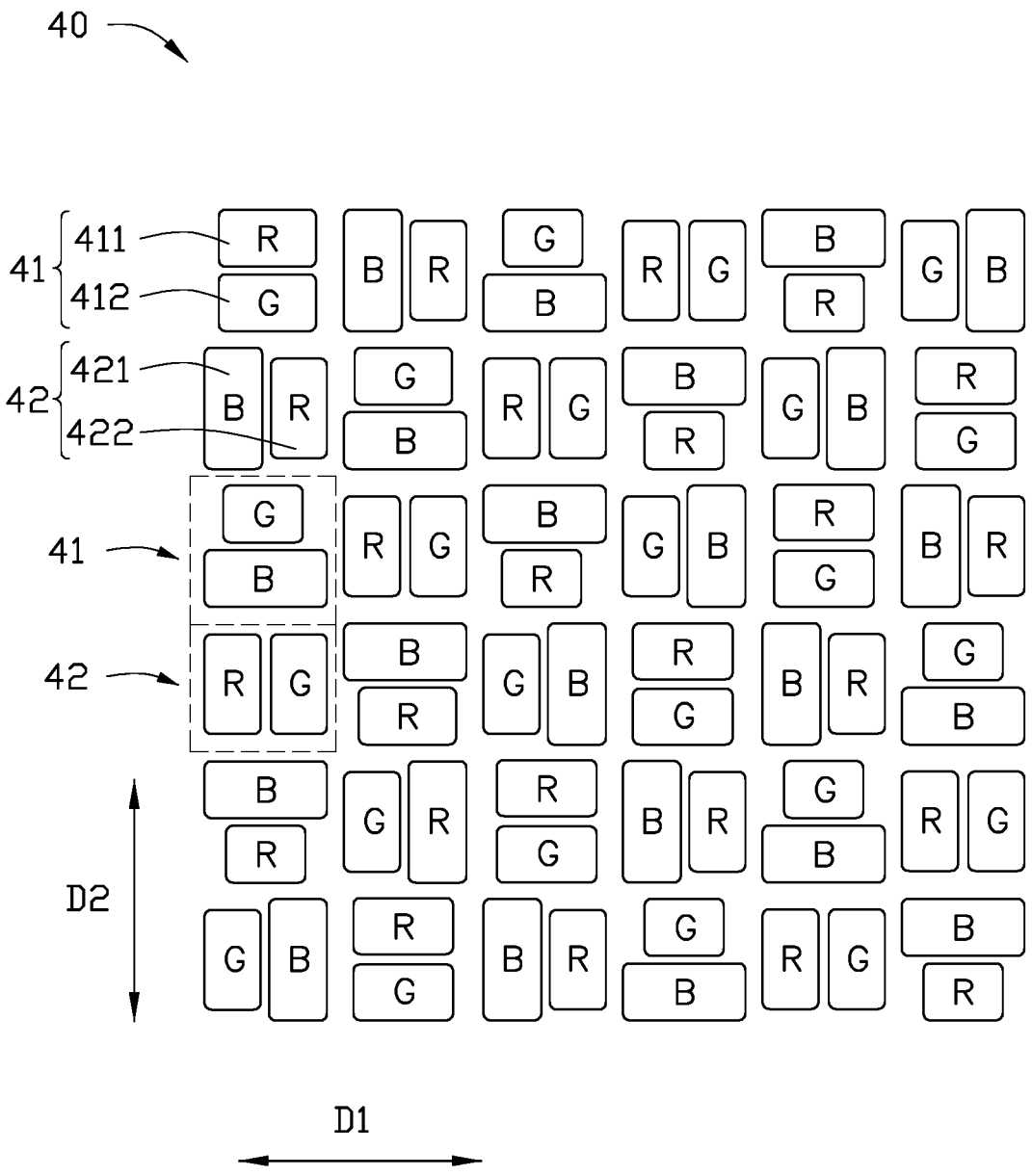
FIG. 15 is a diagrammatic view of the pixel structure in a second format of FIG. 9.

FIG. 15 illustrates the pixel structure 40 in a second format. Each of the first sub-pixel 411, the second sub-pixel 412, the third sub-pixel 421, and the fourth sub-pixel 422 can be one of an R sub-pixel, a G sub-pixel, and a B sub-pixel.

Based on the pixel structure, any three adjacent sub-pixels with different colors can form a dynamic pixel. Therefore, a display performance of the pixel structure is improved. Meanwhile, the dynamic pixel can be utilized to increase the resolution and visual quality of the image device.

While various exemplary and preferred embodiments have been described, the disclosure is not limited thereto. On the contrary, various modifications and similar arrangements (as would be apparent to those skilled in the art) are intended to also be covered. Therefore, the scope of the appended claims should be accorded the broadest interpretation so as to encompass all such modifications and similar arrangements.

What is claimed is:

1. A pixel structure comprising:

a plurality of first pixel groups; and a plurality of second pixel groups;

wherein the first pixel groups and the second pixel groups are arranged in a matrix manner; the first pixel groups and the second pixel group are staggered with each other along a first direction, and are simultaneously staggered with each other long a second direction; each of the first pixel groups comprises a first sub-pixel and a second sub-pixel; each of the second pixel groups comprises a third sub-pixel and a fourth sub-pixel; three of the first sub-pixel, the second sub-pixel, the third sub-pixel, and the fourth sub-pixel, which are adjacent to each other, cooperate with each other to form a dynamic pixel unit.

2. The pixel structure of claim 1, wherein the first pixel group cooperates with the third sub-pixel or the fourth sub-pixel of the second pixel group adjacent to the first pixel group along the first direction to form a dynamic pixel unit.

3. The pixel structure of claim 1, wherein the second pixel group cooperates with the first sub-pixel or the second dub-pixel of the first pixel group adjacent to the second pixel group along the second direction to form a dynamic pixel unit.

4. The pixel structure of claim 1, wherein the dynamic pixel unit is formed by an X sub-pixel, a Y sub-pixel, and a Z sub-pixel.

5. The pixel structure of claim 1, wherein the dynamic pixel unit is formed by an R sub-pixel, a G sub-pixel, and a B sub-pixel.

6. The pixel structure of claim 1, wherein the first sub-pixel and the second sub-pixel are parallel with each other along the first direction; the third sub-pixel and the fourth sub-pixel are parallel with each other along the second direction.

7. The pixel structure of claim 1, wherein each of the first sub-pixel, the second sub-pixel, the third sub-pixel, and the fourth sub-pixel is substantially a rectangular shape; lengths of the first sub-pixel and the second sub-pixel run parallel with each other along the first direction, and lengths of the third sub-pixel and the fourth sub-pixel run parallel with each other along the second direction.

8. The pixel structure of claim 7, wherein the lengths of the first sub-pixel, the second sub-pixel, the third sub-pixel, and the fourth sub-pixel are equal with each other; and the widths of the first sub-pixel, the second sub-pixel, the third sub-pixel, and the fourth sub-pixel are equal with each other.

9. The pixel structure of claim 7, wherein the length of one of the first sub-pixel, the second sub-pixel, the third sub-pixel, and the fourth sub-pixel in the same dynamic unit is different from the rest of the first sub-pixel, the second sub-pixel, the third sub-pixel, and the fourth sub-pixel in the same dynamic unit.

10. The pixel structure of claim 9, wherein the widths of the first sub-pixel, the second sub-pixel, the third sub-pixel, and the fourth sub-pixel are equal with each other.

11. The pixel structure of claim 1, wherein the dynamic pixel unit is formed by the first pixel group and the fourth sub-pixel of the second pixel group adjacent to the first pixel group along the first direction.

12. The pixel structure of claim 1, wherein the dynamic pixel unit is formed by the first pixel group and the third sub-pixel of the second pixel group adjacent to the first pixel group along the first direction.

13. The pixel structure of claim 1, wherein the dynamic pixel unit is formed by the second pixel group and the first sub-pixel of the first pixel group adjacent to the second pixel group along the second direction.

14. The pixel structure of claim 1, wherein the dynamic pixel unit is formed by the second pixel group and the second sub-pixel of the first pixel group adjacent to the second pixel group along the second direction.

* * * * *